US006363679B1

(12) United States Patent
Rutherford

(10) Patent No.: US 6,363,679 B1
(45) Date of Patent: Apr. 2, 2002

(54) FASTENING DEVICE

(75) Inventor: Barry Rutherford, Chatsworth, CA (US)

(73) Assignee: Flannery, Inc., San Fernando, CA (US)

( * ) Notice: Subject to any disclaimer, the term of this patent is extended or adjusted under 35 U.S.C. 154(b) by 0 days.

(21) Appl. No.: 09/330,772

(22) Filed: Jun. 11, 1999

(51) Int. Cl.[7] ..... E04C 5/16

(52) U.S. Cl. ..... 52/681; 52/443; 52/454; 411/546; 411/160; 256/10

(58) Field of Search ..... 411/546, 531, 411/533, 543, 160; 52/443, 681, 454; 256/10, 35, 69

(56) References Cited

U.S. PATENT DOCUMENTS

| | | | | | |
|---|---|---|---|---|---|
| 797,545 | A | * | 8/1905 | Ette | 411/531 |
| 1,517,035 | A | | 11/1924 | Voight | |
| 1,541,360 | A | | 6/1925 | Keas et al. | |
| 1,546,522 | A | | 7/1925 | Voight | |
| 1,563,785 | A | | 12/1925 | Peterson | |
| 1,573,961 | A | * | 2/1926 | Zucker | 411/531 |
| 1,587,879 | A | | 6/1926 | Voight | |
| 1,624,193 | A | | 4/1927 | Voight | |
| 1,640,303 | A | | 8/1927 | Voight | |
| 1,711,928 | A | | 5/1929 | Doucett et al. | |
| 1,714,457 | A | | 5/1929 | Voight | |
| 1,767,565 | A | | 6/1930 | Thrift et al. | |
| 4,174,148 | A | * | 11/1979 | Obuch et al. | 339/246 |
| 4,434,597 | A | | 3/1984 | Fischer | 52/681 |
| 4,581,871 | A | | 4/1986 | Blucher et al. | 52/681 |
| 6,082,942 | A | * | 7/2000 | Swick | 411/368 |

FOREIGN PATENT DOCUMENTS

| | | |
|---|---|---|
| FR | 1464863 | 1/1967 |

* cited by examiner

*Primary Examiner*—Beth A. Stephan
*Assistant Examiner*—Dennis L. Dorsey
(74) *Attorney, Agent, or Firm*—Christie, Parker & Hale, LLP

(57) ABSTRACT

Fastening devices of this invention comprise a screw and a spacer element. The spacer element can be cylindrical in shape and includes a central opening extending between opposite axial surfaces. One or more grooves are disposed within and extend diametrically along at least one axial spacer surface. The groove is adapted to accommodate a wire section of a wire lath. The screw includes a head at one axial end positioned adjacent the spacer groove, and a tip at an opposite axial end for penetrating and engaging a surface of an adjacent structure. The head includes an enlarged diameter section that extends radially outwardly therefrom a sufficient distance to cover at least a portion of the groove when the mounting means is disposed within the central opening. The fastening device is used to attach a wire lath to another surface by placing a wire section of the wire lath within the spacer groove, and driving the mounting means into the other surface. During the driving step, the spacer element is interposed between the other surface and the mounting means enlarged diameter section, and the wire section is secured between the groove and the enlarged diameter section to permanently attach the wire lath to the other surface.

25 Claims, 3 Drawing Sheets

FASTENING DEVICE

FIELD OF THE INVENTION

This invention relates to fastening devices used to attach wire lath to a wall surface and maintain the wire lath a desired distance therefrom and, more particularly, fastening devices designed to attach welded wire and woven wire lath to residential and commercial wall surfaces and framing.

BACKGROUND OF THE INVENTION

In the construction of residential homes and commercial buildings, the wall surfaces are formed from suitable framing, e.g., wood or steel depending on the particular application. A welded wire or woven wire lath or grid is placed over the framing in preparation for subsequent application of plaster or stucco. In order to provide a suitable surface for applying and retaining the plaster or stucco, it is important that the wire lath be maintained a desired distance away from the framing surface. The void space formed between the wire lath and the framing is necessary for retaining the applied plaster or stucco to the vertical wall surface. Without the use of such wire lath and void space, any plaster or stucco applied to the otherwise bare frame surface would slump and/or run downwardly due to gravity.

Past methods of applying wire laths to framing have included the use of an attachment device in the form of a nail and deformable element disposed around the nail. U.S. Pat. No. 1,517,035 is the subject of such a furring nail, wherein the deformable element is a spacer in the form of a sheet of metal. The spacer is disposed concentrically around the nail and includes a deformable wing that is designed to be bent around an adjacent wire of the lath, after the nail has been driven into place within the wood under structure, to both retain the lath against the nail and maintain the lath at a spaced apart distance from the underlying structure. The use of such furring nail, however, is both labor intensive and time consuming because it requires at least three application steps. A first step to combine the nail with the spacer element. A second step to attach the nail to the underlying structure. And a third step to deform the spacer element to provide attachment with the wire lath.

Past methods of applying wire laths to framing have also included the use of an attachment device in the form of a screw with a spacer element disposed therearound. U.S. Pat. No. 4,434,597 is the subject of such a fastening device comprising a dowel, that can be attached to an underlying surface by screw, having a wire lath holding device at one dowel end. More specifically, the dowel is attached to an underlying structure by cam action by use of a screw within the dowel. The dowel includes a single channel at an end opposite the underlying structure positioned perpendicular to the dowel to accommodate placement of a single wire lath strand therein. A web extends away from the dowel end towards the dowel end attached within the underlying structure to provide a desired spacing between the underlying structure and the attached wire lath.

The use of such fastening device, however, requires at least four application steps that are both labor intensive and time consuming. A first step involves drilling or boring a pilot hole into the underlying structure for placement of the dowel therein. A second step involves placing the screw within the dowel, and inserting the screw/dowel assembly into the pilot hole. A third step involves screwing the screw into the dowel to form an attachment between the underlying structure and the dowel by cam action. And a forth step involves rotating the dowel 90 degrees so that the channel of the grid holding device engages a wire from the lath for retaining the wire therein.

It is, therefore, desirable that a fastening device be constructed that can be easily used to attach a wire lath to an underlying structure in a manner that: (1) is neither labor nor time intensive to use; (2) provides complete and reliable wire entrapment; and (3) provides consistent wire lath distance from the underlying wall structure. It is further desired that the fastening device be adapted for use with different types of underlying surface materials without the need for special tools or installation procedures.

SUMMARY OF THE INVENTION

Fastening devices, constructed according to principles of this invention, comprise a mounting means, e.g., a nail, screw, or the like, and a spacer element. The spacer element can be cylindrical in shape and includes a central opening extending between opposite axial surfaces. One or more grooves are disposed within and extend diametrically along at least one axial spacer surface. The groove is adapted to accommodate a wire section of a wire lath. The mounting means includes a head at one axial end positioned adjacent the spacer groove, and a tip at an opposite axial end for penetrating and engaging a surface of an adjacent structure, e.g., a wall or frame structure. The head includes an enlarged diameter section that extends radially outwardly therefrom a sufficient distance to cover at least a portion of the groove when the mounting means is disposed within the central opening.

The fastening device is used to attach a wire lath to another surface by placing a wire section of the wire lath within the spacer groove and driving the mounting means into the other surface. During the driving step, the spacer element is interposed between the other surface and the mounting means enlarged diameter section, and the wire section is secured between the groove and the enlarged diameter section to attach the wire lath to the other surface.

Configured in this manner, the fastening device reduces the amount of steps required in the field to install a wire lath, thereby reducing time and labor. Additionally, the fastening device of this invention provides consistent full wire embedments that are completely furred, thereby providing improved attachment reliability.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

Fastening devices of this invention are adapted for use in attaching welded or woven wire lath to underlying structures such as wood and steel stud framing. Fastening devices of this invention generally comprise a screw and a spacer that is specially designed to retain the engagement of the screw therein, to provide consistent full wire embedment between the spacer and screw during installation of the screw within the underlying structure, and to provide consistent stand off space or distance between the wire lath and the underlying structure surface.

Figure 1:
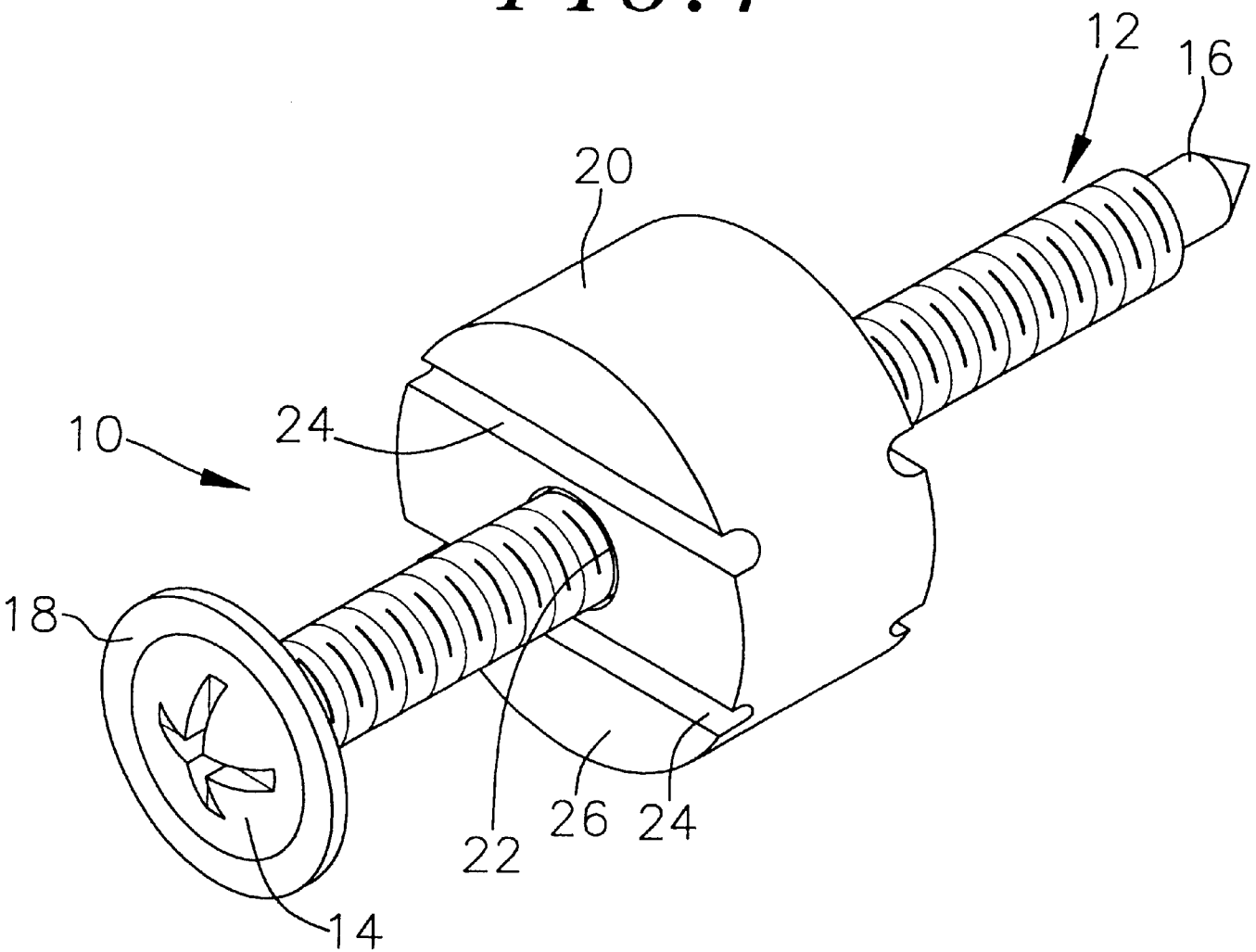
FIG. 1 is perspective view of a fastening device constructed according to principals of this invention.

FIG. 1 illustrates a fastening device 10 of this invention comprising a screw 12 having a head 14 at one axial end and a tip 16 at an opposite axial end. The tip 16 can be threaded, for threaded engagement within a threaded opening, or can be self-tapping, for insertion within a predrilled or pilot hole. In a preferred embodiment, the screw tip 16 is self threading and self tapping to facilitate installation of the screw in a single operation within the need to providing a pilot opening. The screw head 14 includes a flared collar 18 that extends radially outwardly therefrom a desired distance. As discussed in greater detail below, the diameter of the collar 18 is sufficient to cover the wire section captured within the spacer. Although a screw is illustrated in FIG. 1, it is to be understood that fastening devices of this invention can use a nail instead of a screw to facilitate use of the fastening device with certain underlying structure materials, e.g., wood.

A spacer 20 is disposed around a section of the screw 12 and includes a central opening 22 that extends axially through the spacer for accommodating placement of the screw therethrough. In a preferred embodiment, the spacer 20 has a generally cylinder shape with an outside diameter that is slightly greater than that of the screw collar. The spacer has an axial thickness that can be varied to provide a desired wire lath offset or distance from the underlying wall or frame structure. The spacer can be formed from any suitable structural material that is not readily deformable both when installed with the screw into the underlying structure, and when installed with the wire lath. In a preferred embodiment, the spacer is molded from a plastic material.

The spacer 20 includes at least one groove 24 that runs diametrically across a spacer top surface 26. The groove 24 is positioned adjacent the central opening 22 so that, when the screw is inserted completely within the spacer, at least a portion of the groove is covered by the screw collar 18. The groove is sized and shaped to accommodate placement of a wire section of a wire lath therein. It is, therefore, understood that the groove can be sized and shaped to accommodate a variety of different wire sizes and shapes. In a preferred embodiment, as illustrated in FIG. 1, the spacer includes a pair of grooves 24 that run parallel with each other, and that are positioned at opposite sides of the central opening 22 diametrically, along the spacer top surface 26.

While fastening devices of this invention can function in their intended manner using spacer with a single groove, a spacer having two grooves is desired because it enables a single spacer to be used at join two different wire laths together, i.e., it enables the spacer to act as a joint where each groove accepts a wire section from two overlapping wire lath sheets. It is common practice that wire lath sheet edges overlap one another by at least one inch. The dual groove spacer is configured to accommodate this practice. Additionally, the use of two grooves, rather than one groove, makes installation simpler and less time consuming, e.g., the installer has two potential wire insertion points rather than one, thus minimizing the time spent adjusting the spacer for engagement with the wire.

Figure 2:
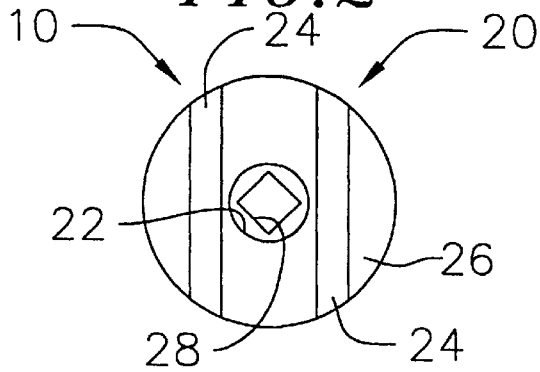
FIG. 2 is a top plan view of a spacer element used with the fastening device of FIG. 1.

FIG. 2 shows the spacer element 20 as viewed looking downwardly onto one of its axial surfaces 26. For purposes of easing installation of the screw and spacer element, and subsequent use of the assembled fastening device in the field, the spacer element 20 is constructed having two identically configured axial surfaces. In a preferred embodiment, the spacer element 20 comprises a pair of grooves 24 running diametrically across both of its axial surfaces. Placement of the grooves on each axial surface expedites the time associated with assembling the spacer with the screw, by avoiding the need insert the screw into spacer from a particular spacer end. Alternatively, the spacer element 20 can comprise two pairs of grooves 24 on each axial end, each pair comprising two parallel groves, the two pairs being arranged perpendicular to each other.

As shown in FIG. 2, the central opening 22 is intentionally configured to maintain engagement of the screw therein. Rather then being completely round and oversized to accommodate placement of the screw therein, the central opening 22 is designed having at least a section that is configured to form an interference fit with the screw to prevent the screw from becoming detached from the spacer element before use. In a preferred embodiment, the central opening includes a non-circular section 28 that is in the form of a thin membrane configured to form a temporary interference fit with the screw when inserted into the opening 22 to resist the screw from becoming detached by other than intentional action, e.g., to prevent the screw from dropping out of the spacer element when the fastening device is oriented the screw head pointed downwardly.

Figure 3:
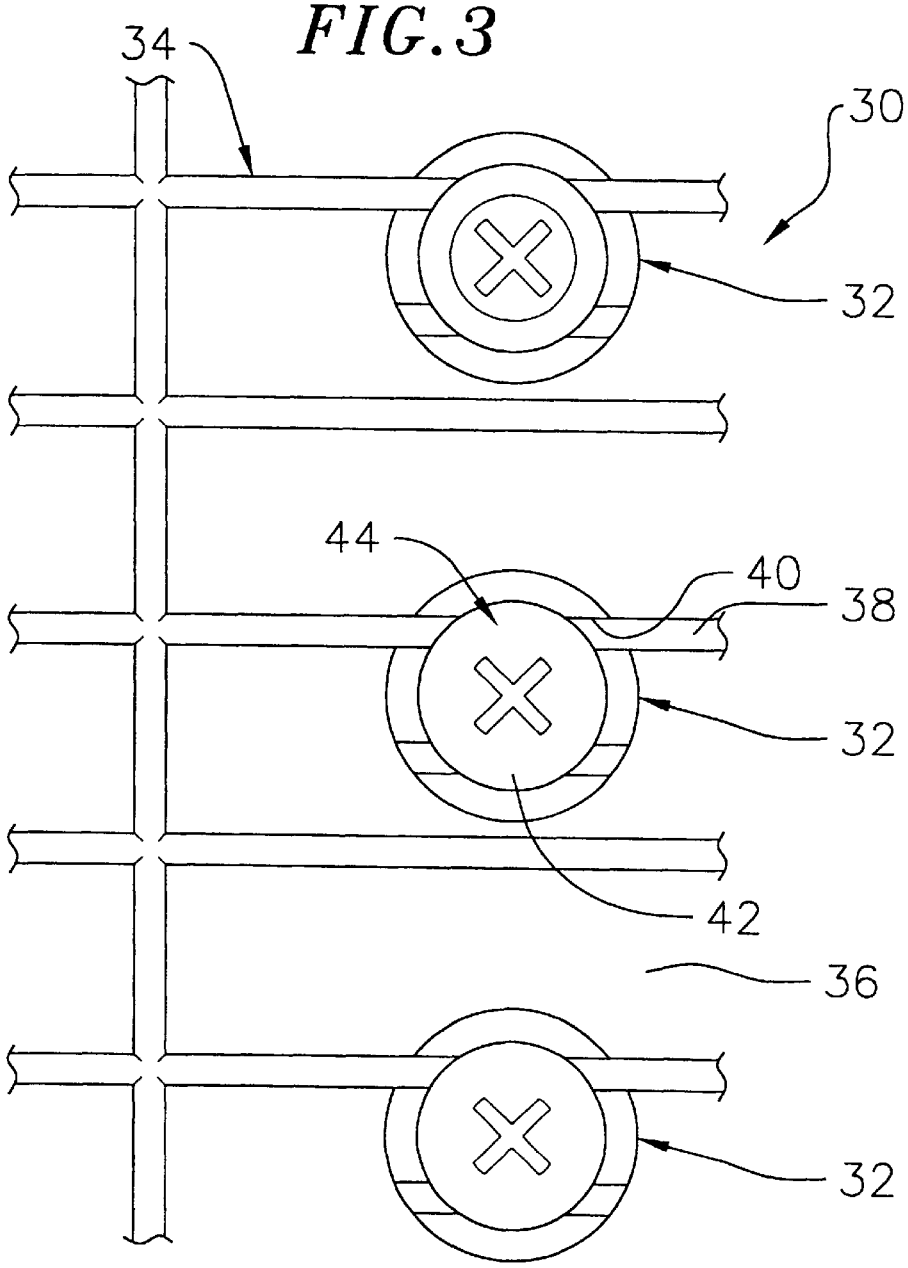
FIG. 3 is a top plan view of a wire lath attached to an underlying structure by as number of fastening devices of this invention.

FIG. 3 shows a wire lath assembly 30, constructed according to principles of this invention, comprising a number of fastening devices 32 used in a representative manner to attach a representative section of wire lath 34 to an underlying surface 36. A wire section 38 of the wire lath 36 is disposed within a respective spacer element groove 40, and is interposed between the groove and the screw collar 42 of a respective screw 44. It is to be understood that the assembly illustrated in FIG. 3 is provided for purposes of reference and it not intended to limit the location or placement of the fastening devices to achieve a desired attachment of a wire lath to an underlying structure. The placement of the fastening devices with the wire lath will vary depending on the size and structure of the wire lath, and the particular wall structure being constructed.

Figure 4:
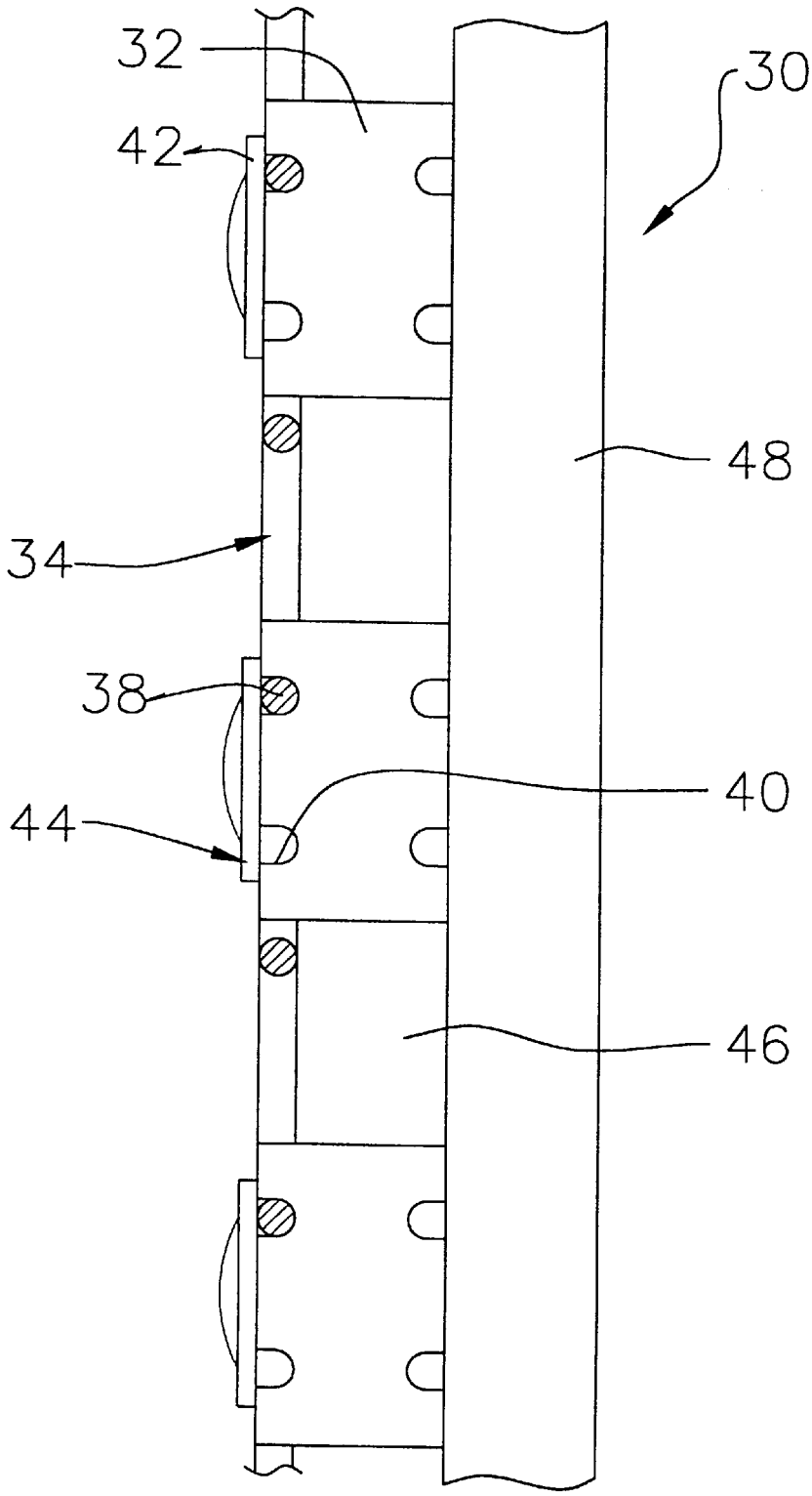
FIG. 4 is a side elevational view of the wire lath attachment of FIG. 3 comprising use of fastening elements of this invention.

FIG. 4 is a side view of the wire lath assembly 30 of FIG. 3 showing how the fastening devices 32 both are attached to the wire lath 36, and provide a desired wire lath spacing 46 from an underlying supporting structure 48. In an example embodiment, the underlying supporting structure is in the form of a steel stud frame. Alternatively, however, fastening devices of this invention can be used with a variety of different underlying structure materials, such as wood, concrete, masonry, and the like. The fastening device of this invention can be adapted for use with such other types of underlying structure material by changing the type of attaching member that is used with the spacer element. Accordingly, it is understood that screws or attaching members other than that described or illustrated are intended to be used with the spacer element of the fastening device without departing from this invention.

Fastening devices of this invention are used to attach welded and woven wire lath to an underlying support structure in the following manner. A wire lath is temporarily placed, i.e., tacked, into position against the underlying wall structure. Fastening devices of this invention, comprising screw and spacer elements that have been assembled together either in the field or beforehand, are installed into position with the wire lath by placing a wire section of the lath into a respective spacer groove so that the screw head is facing outwardly from the spacer for engagement by a suitable screw driving means. After the fastening devices are attached to the wire lath a screw driving means is used to simultaneously tap and drive the screw into the underlying wall surface and trap the respective wire lath wire section between the screw collar and respective spacer of each fastening device. In a preferred embodiment, the screw is driven into the underlying structure using a screw driving gun that operates at high rpm, e.g., at 2,500 rpm. Thus, the step of tapping, driving and trapping each fastening device takes place in approximately one second.

A feature of this invention is the ability to tap and drive the fastening device into the underlying structure, and attach the device to the wire lath at the same time, i.e., during the same steps in the field. The ability to combine the steps of tapping, driving and attaching into a single step drastically reduces the amount of labor and time required to install wire lath in the field. The fastening device of this invention is intentionally designed to facilitate combining these three steps by both providing a spacer element and screw assembly that is configured to entrap the wire section as the screw is lowered onto the spacer element, and by manufacturing the spacer element from a material that does not become deformed or rotate during the combined steps. For example, a spacer element that is formed from a readily deformable material such as paper could tear as the screw is being rotated, causing the wire section to be removed or torn from the groove. Additionally, a spacer element that is formed without grooves will rotate when the screw is being driven into the underlying structure at high rpm (2,500 rpm). Rotation of the spacer element is not desired because it is known to tear through the underlying waterproof paper covering the underlying wall structure, thereby exposing the underling structure to moisture and moisture-related damage.

Additionally, fastening devices of this invention are specifically designed to minimize the amount of time that is spent in the field during wire lath attachment by both increasing the number of ways that the wire section and spacer element can be combined, e.g., by using more than one groove, and by securely retaining the screw within the spacer, thereby avoiding the need to reassemble the fastening device members in the field.

Although limited embodiments of fastening devices have been specifically described and illustrated herein; many modifications and variations will be apparent to those skilled in the art. Accordingly, it is to be understood that, within the scope of the appended claims, fastening devices constructed according to principles of this invention may be embodied other than as specifically described herein.

What is claimed is:

1. A fastening device comprising:

a screw means having a head at one axial end and a tip and an opposite axial end, the head having a collar that extends radially outwardly a distance therefrom; and a spacer disposed around a portion of the screw, the spacer including:

a central opening extending therethrough from one axial spacer surface to an opposite axial spacer surface, the screw being disposed within the central opening; and at least one groove disposed within an axial spacer surface and extending diametrically thereacross, the groove being positioned adjacent the central opening the collar radiating outwardly beyond the groove so that at least a portion of the groove is completely covered by the screw collar when the screw is inserted into the central opening.

2. The device as recited in claim 1 wherein the spacer comprises a pair of parallel grooves, each groove on an opposite side of central opening.

3. The device as recited in claim 2 wherein the spacer comprises a pair of parallel grooves on each axial spacer surface.

4. The device as recited in claim 1 wherein the spacer is formed from a material selected from the group consisting of plastic, wood, metal, and combinations thereof.

5. The device as recited in claim 1 wherein the spacer central opening includes means for providing an interference fit with the screw to retain the screw therein.

6. The device as recited in claim 1 comprising a wire lath including number of fastening devices as recited in claim 1 attached thereto, wherein a wire section of the wire lath is interposed between the spacer groove and screw collar of each fastening device, and at least a portion of the wire section is completely covered by the screw collar.

7. A fastening device for use in attaching a wire lath to an underlying structure comprising:

a spacer element having a generally cylindrical shape and a central opening extending therethrough between opposite axial spacer surfaces, wherein at least one axial spacer surface includes at least one groove disposed therein and extending diametrically thereacross, the spacer element being formed from a material selected from the group consisting of metal, plastic, wood, and combinations thereof; and means for mounting the spacer to another surface, the means being disposed at least partially through the central opening and having a head at one axial end and a tip at an opposite axial end, the head including an enlarged diameter portion that extends radially outwardly therefrom a sufficient distance to completely cover at least a portion of the spacer groove when positioned thereagainst.

8. The device as recited in claim 7 wherein the mounting means is a screw.

9. The device as recited in claim 7 wherein the spacer includes a pair of grooves arranged parallel with one another on each side of the central opening.

10. The device as recited in claim 9 wherein the pair of grooves are on both axial spacer surfaces.

11. The device as recited in claim 7 wherein the central opening includes means for retaining the mounting means therein.

12. The device as recited in claim 11 wherein the mounting means is a screw and at least a section of the central opening is configured to provide an interference fit with the screw to prevent unintended detachment.

13. A wire lath and fastening device assembly comprising:

a wire lath comprising a number of wires joined together;

at least one fastening device attached to a wire section of the wire lath, the device comprising:

a spacer element having a generally cylindrical shape and a central opening extending therethrough between opposite axial spacer surfaces, and wherein at least one axial spacer surface includes a groove disposed therein and extending diametrically thereacross, and wherein a wire section of the wire lath is disposed within the groove; and a screw disposed through the central opening and partially into an underlying surface, the screw having a head at an axial end adjacent the spacer groove and a tip at an opposite axial end, the head including an enlarged diameter portion that extends radially outwardly therefrom a sufficient distance to completely cover at least a portion of the spacer groove and the wire section to attach the wire section to the fastening device.

14. The assembly as recited in claim 13 wherein the spacer includes a pair of grooves arranged parallel with one another on each side of the central opening.

15. The assembly as recited in claim 14 wherein the pair of grooves are on both axial spacer surfaces.

16. The assembly as recited in claim 13 wherein a section of the central opening is configured to provide an interference fit with the screw to prevent unintended detachment.

17. The assembly as recited in claim 13 wherein the spacer element is formed from a material selected from the group consisting of metal, plastic, wood, and combinations thereof.

18. A method for attaching a wire lath a desired distance from an underlying surface comprising the steps of:

positioning a wire lath wire section within a groove disposed along an axial surface of a spacer element, wherein a mounting means is disposed within a central opening of the spacer element, and wherein the mounting means includes an enlarged diameter portion that covers at least a portion of the wire section disposed within the groove;

driving the mounting means into the underlying surface to interpose the spacer element between the enlarged diameter section and the another surface; and securing the wire section between the spacer groove and enlarged diameter section to provide a defined distance between the wire lath and underlying surface.

19. The method as recited in claim 18 wherein the steps of driving and securing are performed simultaneously.

20. A method for attaching a wire lath to another surface comprising the steps of:

positioning a wire lath wire section within a groove disposed along an axial surface of a fastening device spacer element comprising a screw disposed through a spacer element central opening, wherein the screw includes an enlarged diameter portion at an axial end adjacent the spacer element groove that covers at least a portion of the wire section disposed within the groove;

fastening the screw into another surface so that the spacer element is interposed between the screw enlarged diameter section and the another surface, and securing the wire lath wire section between the spacer groove and enlarged diameter section, wherein at least a portion of the fastening step occurs simultaneously with the securing step.

21. A fastening device comprising:

a screw means having a head at one axial end and a tip and an opposite axial end, the head having a collar that extends radially outwardly a distance therefrom; and a spacer disposed around a portion of the screw, the spacer including:

a central opening extending therethrough from one axial spacer surface to an opposite axial spacer surface, the screw being disposed within the central opening, wherein the central opening includes means for providing an interference fit with the screw to retain the screw therein; and at least one groove disposed within an axial spacer surface and extending diametrically thereacross, the groove being positioned adjacent the central opening the collar radiating outwardly beyond the groove so that at least a portion of the groove is completely covered by the screw collar when the screw is inserted into the central opening.

22. The device as recited in claim 21 wherein the spacer comprises a pair of parallel grooves, each groove on an opposite side of central opening.

23. The device as recited in claim 22 wherein the spacer comprises a pair of parallel grooves on each axial spacer surface.

24. The device as recited in claim 21 wherein the spacer is formed from a material selected from the group consisting of plastic, wood, metal, and combinations thereof.

25. The device as recited in claim 21 comprising a wire lath including number of fastening devices as recited in claim 1 attached thereto, wherein a wire section of the wire lath is interposed between the spacer groove and screw collar of each fastening device, and at least a portion of the wire section is completely covered by the screw collar.

* * * * *